US005980013A

United States Patent [19]

Takahashi

[11] Patent Number: 5,980,013

[45] **Date of Patent: *Nov. 9, 1999**

[54] DRIVING METHOD FOR INK EJECTION DEVICE AND CAPABLE OF EJECTING INK DROPLETS REGARDLESS OF CHANGE IN TEMPERATURE

[75] Inventor: Yoshikazu Takahashi, Nagoya, Japan

[73] Assignee: Brother Kogyo Kabushiki Kaisha, Nagoya, Japan

[ * ] Notice: This patent is subject to a terminal disclaimer.

[21] Appl. No.: 08/780,159

[22] Filed: Dec. 26, 1996

[30] Foreign Application Priority Data

Dec. 25, 1995 [JP] Japan ..... 7-336916
Jan. 25, 1996 [JP] Japan ..... 8-011022

[51] Int. Cl.[6] ..... B41J 29/38

[52] U.S. Cl. ..... 347/14; 347/11

[58] Field of Search ..... 347/11, 14, 19, 347/68–72

[56] References Cited

U.S. PATENT DOCUMENTS 3,946,398 3/1976 Kyser et al. ..... 347/68
4,723,129 2/1988 Endo et al. ..... 347/56
4,879,568 11/1989 Bartky et al. ..... 347/69
5,805,177 9/1998 Takahashi ..... 347/11

FOREIGN PATENT DOCUMENTS

B2-53-12138 4/1978 Japan .
B2-61-59914 12/1986 Japan .
A-63-247051 10/1988 Japan .
A-3-234629 10/1991 Japan .

*Primary Examiner*—Benjamin R. Fuller
*Assistant Examiner*—Sydney O. Johnson, Jr.
*Attorney, Agent, or Firm*—Oliff & Berridge, PLC

[57] ABSTRACT

In view of the fact that the ink viscosity is high when atmospheric temperature is low whereas the same is low when the atmospheric temperature is high, two types of driving signals are selectively applied to an actuator depending on the temperature so that ink droplets are ejected at a constant speed regardless of change in atmospheric temperature. Alternatively, when the temperature is below a predetermined value, ink droplets are ejected while heating the ink filling an ink channel. When the ink temperature is increased above the predetermined value, heating of the ink is halted.

18 Claims, 11 Drawing Sheets

FIG. 11

| W (xT) | EVALUATION |
|---|---|
| 0.3 | × |
| 0.5 | △ |
| 1.0 | ○ |
| 1.5 | △ |
| 1.7 | × |
| 2.0 | × |
| 2.3 | × |
| 2.5 | △ |
| 3.0 | ○ |
| 3.5 | △ |
| 3.7 | × |
| 4.0 | × |
| 4.3 | × |
| 4.5 | △ |
| 5.0 | ○ |
| 5.5 | △ |
| 5.7 | × |
| 6.0 | × |
| 6.3 | × |
| 6.5 | △ |
| 7.0 | ○ |

○ SPEED : 4.5~5.5 m/s

△ SPEED : 2.0~3.0 m/s

× EJECTION DISABLED

DRIVING METHOD FOR INK EJECTION DEVICE AND CAPABLE OF EJECTING INK DROPLETS REGARDLESS OF CHANGE IN TEMPERATURE

BACKGROUND OF THE INVENTION

1. Field of the Invention

The present invention relates to a driving method for an ink ejection device. More particularly, the invention relates to a driving method for an ink ejection device capable of ejecting ink droplets regardless of change in environmental temperature.

2. Description of Related Art

Non-impact type printing devices have recently taken the place of conventional impact type printing devices and are holding an ever-growing share of the market. Of these non-impact type printing devices, ink-ejecting type printing devices have the simplest operation principle, but are still capable of effectively and easily performing multi-gradation and color printing. Of these devices, a drop-on-demand type for ejecting only ink droplets required used for printing has rapidly gained popularity because of its excellent ejection efficiency and low running cost.

Two representative drop-on-demand printers types are the Kyser type, such as disclosed in U.S. Pat. No. 3,946,398, and the thermal ejecting type, such as disclosed in U.S. Pat. No. 4,723,129. These types of drop-on-demand printers have disadvantages. The Kyser type is difficult to design in a compact size. The thermal ejecting type requires heat-resistant ink because the ink is heated to a high temperature when ejected.

A shear mode type printer, such as disclosed in U.S. Pat. No. 4,879,568, has been proposed to simultaneously solve the above disadvantages.

As shown schematically in FIGS. 1(*a*) and 1(*b*), the shear mode type of ink ejection device 600 comprises a bottom wall 601, a ceiling wall 602, and elongated shear mode actuator walls 603 sandwiched therebetween. Each actuator wall 603 includes a lower wall 607 adhesively attached to the bottom wall 601 and an upper wall 605 adhesively attached to the ceiling wall 602. The upper and lower walls 605, 607 are polarized in the directions indicated by arrows 609, 611 respectively. Alternating pairs of actuator walls 603 forms in alternation ink channels 613 therebetween or spaces 615, which are narrower than the ink channels 613.

A nozzle plate 617 is fixedly secured to one end of the actuator walls 603. The nozzle plate 617 is formed with nozzles 618 at positions corresponding to the ink channels 613. Electrodes 619 and 621 are provided on both side surface of each actuator wall 603. Each of the electrodes 619, 621 is covered by an insulating layer (not shown) to insulate it from the ink. The electrodes 621 confront spaces 615 and are connected to a ground 623. The electrodes 619 are provided in the ink channels 613 and are connected to an actuator driving circuit 625, such as a silicon chip. A manifold member 628 having a sealing plate 627 is fixedly secured to the other ends of the actuator walls 603. The ink channels 613 are in fluid communication with a common ink chamber 626 defined by the manifold member 628. The sealing plate 627 prevents ink from the common ink chamber 626 from entering the spaces 615.

Next, a method for manufacturing the ink ejection device 600 will be described. First, a piezoelectric ceramic layer polarized in the direction 611 is adhered to the bottom wall 601, and a piezoelectric ceramic layer polarized in a direction 609 is adhered to the ceiling wall 602. Incidentally the piezoelectric ceramic layers are formed to thicknesses required to produce the proper heights of the lower walls 607 and the upper walls 605. Next, parallel grooves are cut into the piezoelectric ceramic layers using a diamond cutting disc to form the lower walls 607 and the upper walls 605. The electrodes 619 and 621 are then formed on the side surfaces of the lower walls 607 using vacuum-deposition techniques. The insulating layer is formed onto the electrodes 619 and 621. Likewise, the electrodes 619 and 621 are provided on the side surfaces of the upper walls 605 and the electrodes 619 and 621 are covered by the insulating layer.

The vertices of the upper walls 605 and the lower walls 607 are adhered to one another to form the actuator walls 603, and consequently the ink channels 613 and the spaces 615. Next, the nozzle plate 617 formed with the nozzles 618 at positions corresponding to the ink channels 613 is attached to the ends of the actuator walls 603. The manifold member 628 is adhered to the other ends of actuator walls 603 so that the sealing plate 627 seals the spaces 615 to prevent ink from entering the spaces 615. The circuit 625 and the ground 623 are connected also to the other end of the actuator walls 603.

To eject droplets, a voltage from the actuator driving circuit 625 is applied to the electrodes 619, 921 of each ink channel 613. Pairs of the actuator walls 603 deform outward by the piezoelectric shear effect so that the volume of each ink channel 613 increases. In the example shown in FIG. 2, when a voltage V is applied to the electrodes 621*c* of the ink channel 613*c*, an electric field is generated in the actuator wall 603*e* in the direction indicated by arrows 631, 629 and an electric field is generated in the actuator wall 603*f* in the directions indicated by arrows 632, 630. Because the electric field directions 629 to 632 are at right angles to the polarization direction 609, 611, the actuator walls 603*e*, 603*f* deform outward to increase the volume of the ink channel 613*c* by the piezoelectric shear effect, resulting in a decrease in the pressure in the ink chamber 613*c*, including near the nozzle 618*c*. The negative pressure is maintained for a duration of time T corresponding to a duration of time required for a pressure wave to propagate once across the length of the ink channel 613*c*. During the time duration T, ink is supplied from the manifold 626.

The duration of time T can be calculated by the following formula:

$$T=L/a$$

wherein L is the length of the ink channel 613; and a is the speed of sound through the ink filling channel 613.

Theories on pressure wave propagation teach that at the moment the duration of time L/a elapses after the rising edge of voltage, the pressure in the ink channel 613 inverts to a positive pressure. The voltage applied to the electrode 619*c* of the ink channel 613*c* is returned to 0V in synchronization with this inversion so that the actuator walls 603*e*, 603*f* revert to their initial shape shown in FIG. 1.

The pressure generated when the actuator walls 603*e*, 603*f* return to their initial shape is added to the inverted positive pressure so that a relatively high pressure is generated in the ink channel 613*c*. This relatively high pressure ejects an ink droplet 26 from the nozzle 618*c*.

As shown in FIG. 3, the viscosity of ink used in this type of ink ejection device varies greatly depending on the atmospheric temperature. In the example shown in FIG. 3, the ink has a viscosity of about 6 mPa.s at 25° C. and about 6 mPa.s at 10° C. Because the viscosity of ink varies with temperature in this manner, the speed of the ink droplet is slower at low temperatures than at high temperatures. Therefore, the printing position of ejected droplets on the printing medium cannot be precisely controlled, resulting in poor quality of printed images.

In an attempt to minimize variation in the speed of ejected ink droplets caused by changes in atmospheric temperature, the driving voltage of the ink ejection device has been changed in accordance with changes in atmospheric temperature. However, this driving method requires a complicated driving circuit because different voltage levels must be generated using a combination of two or more power sources. The configuration of the driving circuitry is thus costly.

SUMMARY OF THE INVENTION

It is an object of the present invention to provide a driving method for a low-cost ink ejection device using a single power source, wherein an excellent print quality can be obtained by eliminating variation in the ink ejection speed.

An ink ejection device to which the present invention is applied includes walls defining an ink channel, a nozzle plate, an actuator and a driving circuit. The ink channel has a volume filled with ink and a length defined by two ends opposite to each other. The nozzle plate is attached to one end of the ink channel and formed with a nozzle. The actuator operates to change the volume of the ink channel. The driving circuit drives the actuator by applying thereto pulses of voltage.

According to one aspect of the present invention, there is provided a method of driving the ink ejection device, in which when atmospheric temperature is under a predetermined value, the driving circuit applies a first pulse of voltage to the actuator. The first pulse of voltage has a start edge, a termination edge, a first crest value, and a first duration of time between the start edge and the termination edge. The first duration of time is equal to a pressure wave propagating time required for a pressure wave imparted to the ink filled in the ink channel to propagate over the length of the ink channel. When the atmospheric temperature is above the predetermined value, the driving circuit applies a second pulse of voltage to the actuator. The second pulse of voltage has a start edge, a termination edge, a second crest value equal to the first crest value, and a second duration of time between the start edge and the termination edge of the second pulse of voltage. The second duration of time is three times as long as the pressure wave propagating time.

The actuator is in the form of a wall defining the ink channel, and at least a portion of the actuator is formed from a piezoelectric material. The piezoelectric material is operable In a shear mode.

In operation, in response to each of the start edge of the first pulse of voltage and the start edge of the second pulse of voltage, the volume of the ink channel is increased from an initial volume to an increased volume, causing to generate the pressure wave in the ink filling the ink channel. In response to each of the termination edge of the first pulse of voltage and the termination edge of the second pulse of voltage, the volume of the ink chamber reverts to the initial volume, thereby ejecting an ink droplet from the nozzle.

Although the ink has a temperature-dependent viscosity and the viscosity of the ink increases when the atmospheric temperature is lowered, the ink ejection speed is maintained substantially at a constant speed regardless of change in the atmospheric temperature.

The driving circuit includes a single voltage source supplying a voltage having a predetermined voltage level either positive or negative. The first pulse of voltage and the second pulse of voltage are produced from the voltage supplied by the voltage source so that the first crest value and the second crest value are substantially equal to the predetermined voltage level.

According to another aspect of the present invention, a temperature of ink is monitored and determination is made as to whether or not the temperature of ink is above a predetermined value. When the determination indicates that the temperature of ink is under a predetermined value, the ink filled in the ink channel is heated to lower the viscosity of the ink. When the determination indicates that the temperature of ink is above the predetermined value, the driving circuit applies an ejection pulse signal to the actuator, causing to eject an ink droplet from the nozzle.

After heating the ink, the driving circuit applies the ejection pulse signal to the actuator, causing to eject the ink droplet from the nozzle.

Preferably, the driving circuit disposed near the actuator (or ink channel) is used to generate heat that is applied to the ink. To this effect, the driving circuit produces at least one non-ejection pulse signal to generate the heat. The non-ejection pulse signal is applied to the actuator, wherein the non-ejection pulse signal does not cause to eject the ink droplet from the nozzle.

According to still another aspect of the present invention, a driving circuit is disposed in the vicinity of the actuator, and when atmospheric temperature is under a predetermined value, the driving circuit applies a first pulse train to the actuator. The first pulse train consists of a first number of pulse signals including an ejection pulse signal and at least one non-ejection pulse signal. The ejection pulse signal and the non-ejection pulse signal are produced from the voltage supplied by a voltage source used in conjunction with the driving circuit so as to have a crest value substantially equal to the voltage supplied by the voltage source. The ejection pulse signal, when applied to the actuators causes to eject an ink droplet from the nozzle. The non-ejection pulse signal, when applied to the actuator, does not cause to eject the ink droplet from the nozzle. The driving circuit generates heat resulting from application of the non-ejection signal to the actuator. The heat is applied to the ink filling in the ink channel to lower the viscosity of the ink. When the atmospheric temperature is above the predetermined value, the driving circuit applies a second pulse train to the actuator. The second pulse train consists of a second number of pulse signals smaller than the first number of pulse signals. The second pulse train includes the ejection pulse signal which, when applied to the actuator, causes to eject the ink droplet from the nozzle.

In operation, in response to the ejection pulse signal, the volume of the ink channel is increased from an initial volume to an increased volume, causing to generate a pressure wave in the ink filling the ink channel. Then, the volume of the ink chamber reverts to the initial volume, thereby ejecting the ink droplet from the nozzle. The ejection pulse signal has a duration of time substantially equal to a time duration given by multiplying an odd number to a pressure wave propagating time required for a pressure wave imparted to the ink filled in the ink channel to propagate over the length of the ink channel. The non-ejection pulse signal has a duration of time in a range from $(N-0.3)T$ to $(N+0.3)T$ where N is an odd number and T is the pressure wave propagating time.

In one example, the first pulse train consists of one ejection pulse signal and one non-ejection pulse signal, and the second pulse train consists of one ejection pulse signal.

It is preferable that the ejection pulse signal be applied to the actuator after applying the non-ejection pulse signal to the actuator.

BRIEF DESCRIPTION OF THE DRAWINGS

The particular features and advantages of the invention as well as other objects will become more apparent from the following description taken in connection with the accompanying drawings, in which:

FIG. 1(*b*) is a plan view showing the conventional ink ejection device shown in FIG. 1(*a*);

FIG. 11 is a table illustrating results of experiments showing the relationship between the ink ejection and width of the pulse signal according to the first second embodiment of the present invention.

DETAILED DESCRIPTION OF THE PREFERRED EMBODIMENTS

Driving method for an ink ejection device according to preferred embodiments of the present invention will be described while referring to the accompanying drawings.

Figure 1:
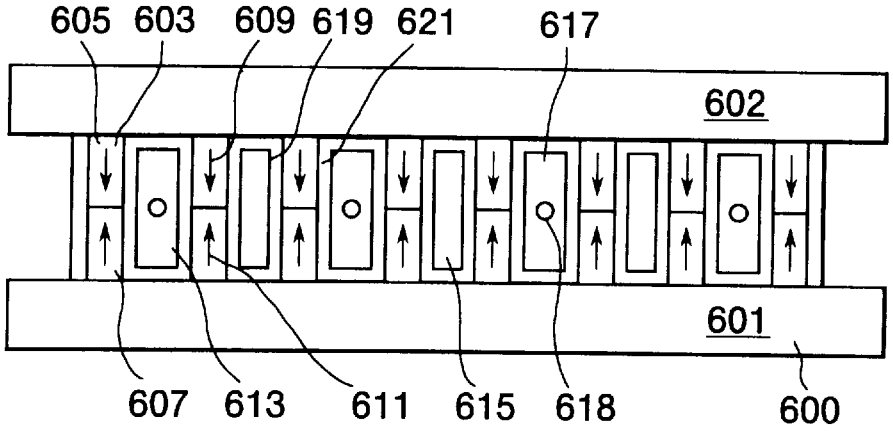
FIG. 1(*a*) is a cross-sectional view showing a conventional ink ejection device, to which the present invention is applied.
Figure 1:
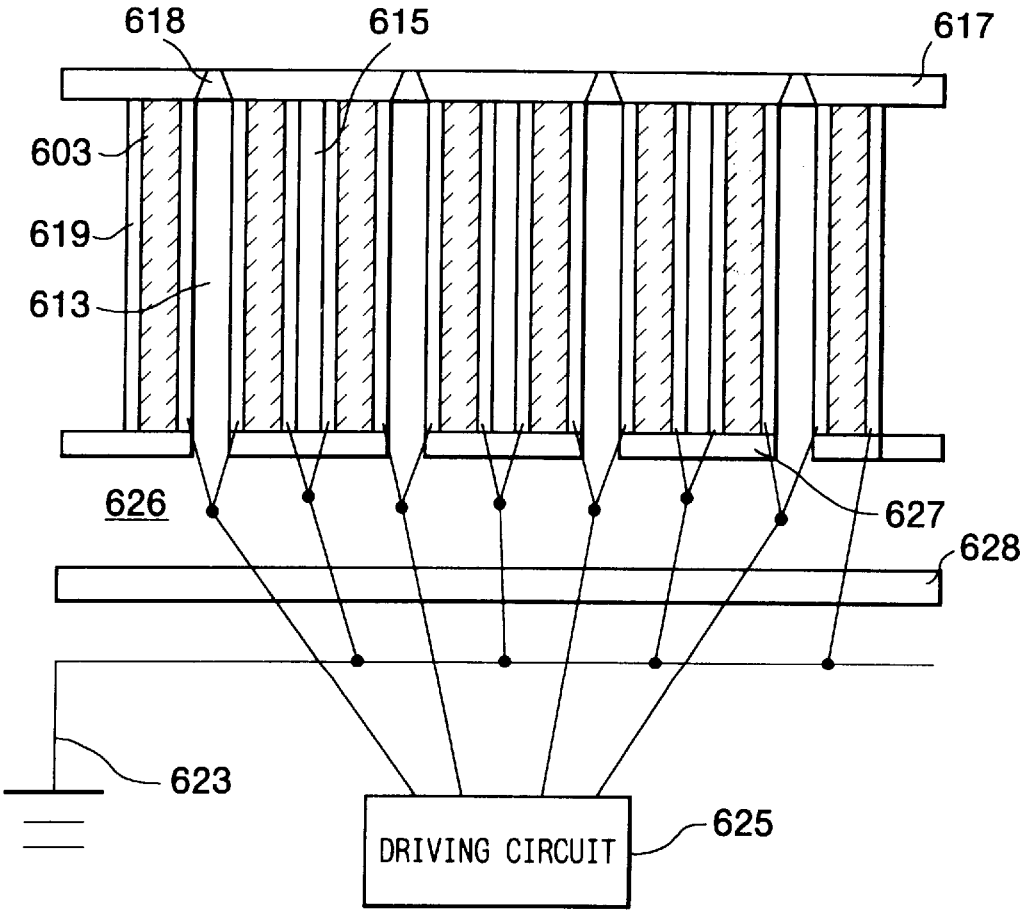
Figure 2:
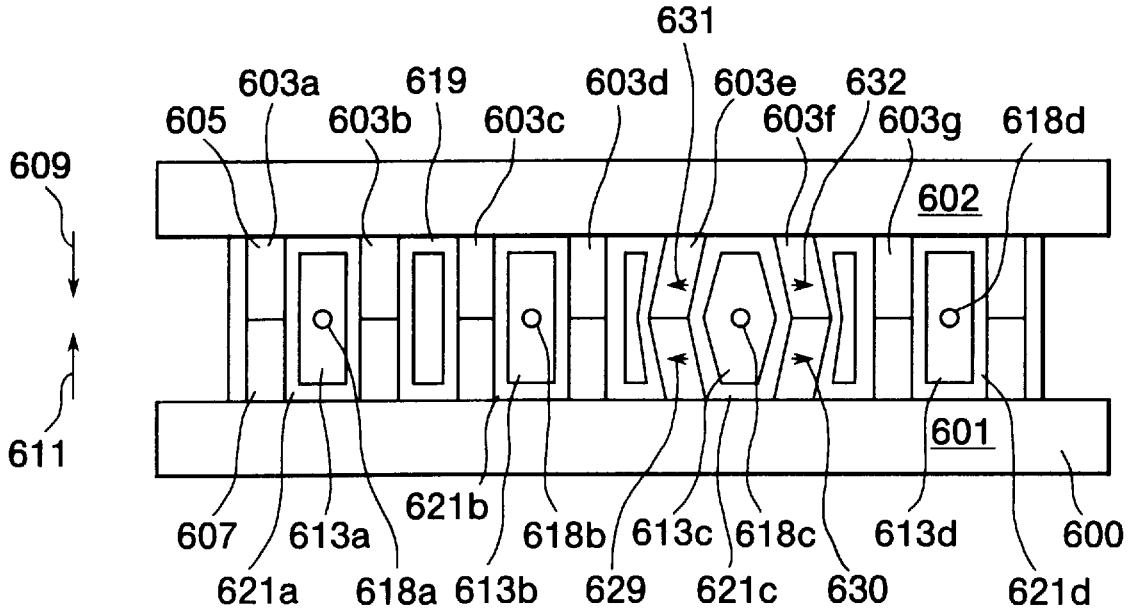
FIG. 2 is a cross-sectional view illustrating an operation of the ink ejection device shown in FIGS. 1(*a*) and 1(*b*)
Figure 3:
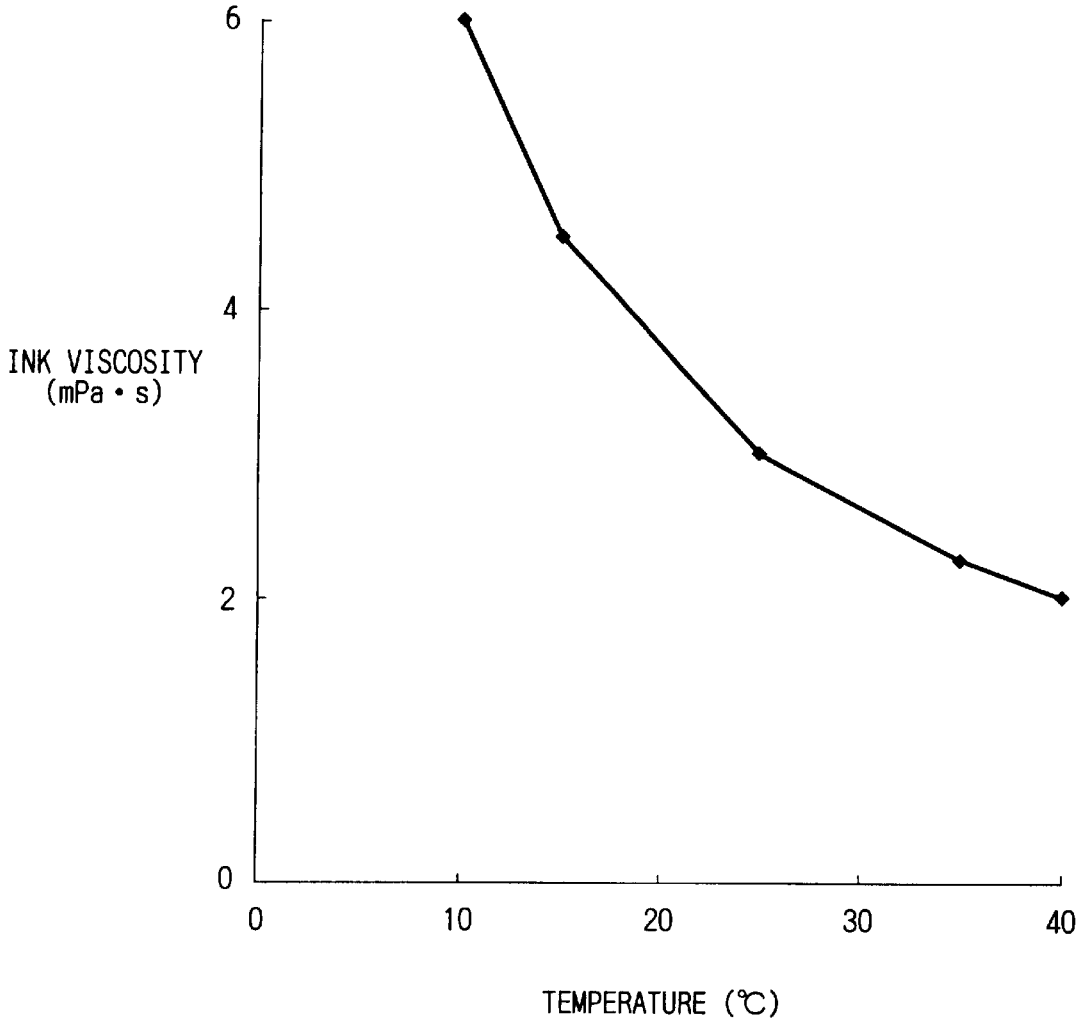
FIG. 3 is a graph showing the relationship between viscosity of ink used in the present invention and atmospheric temperature.

The following embodiments of the present invention are applied to the conventional ink ejection device 600 shown in FIGS. 1(*a*), 1(*b*), and 2. However, in the present embodiment the ink ejection device 600 is driven by an actuator driving circuit 625*a* shown in FIG. 4. Although not shown in the drawings, a microcomputer is connected to the actuator driving circuit 625 for applying input signals X and Y to the actuator driving circuit 625 in a prescribed sequential relation.

Dimensions of the ink ejection device according to the present embodiment will be described. The ink channel 613 is formed to a length of 7.5 mm. The nozzle 618 is formed in the nozzle plate 617 a diameter of 40 mm at its outer side and 72 mm at its inner side and with a length of 100 mm. The ink used in the experiments has a viscosity of 3 mPa.s at 25° C., and the surface tension of 30 mN/m. The ink viscosity is 6 mPa.s at 10° C. and 2 mPa.s at 40° C. A ratio of the ink channel length L to the sound velocity a, i.e., L/a, is 8 msec. The ratio L/a represents a time duration T required for a pressure wave generated in the ink filling the ink channel 613 to propagate one end to the other in a lengthwise direction of the ink channel.

Figure 5:
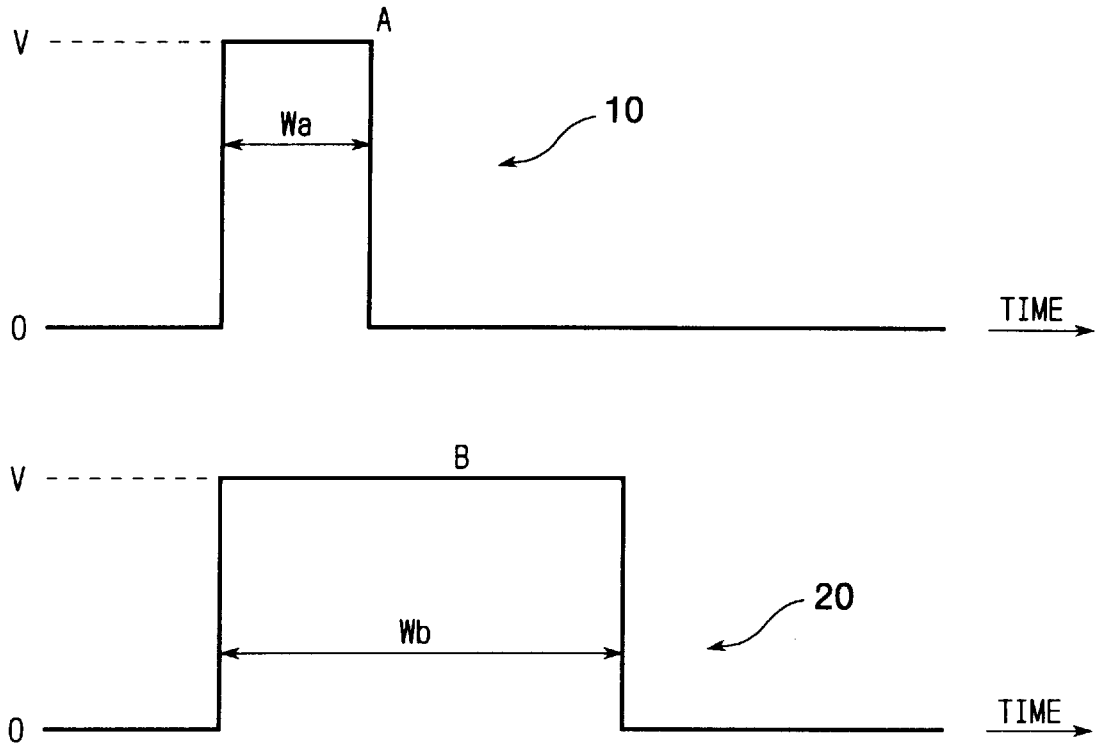
FIG. 5 is a diagram Illustrating voltage waveforms for driving an ink ejection device according to a first embodiment of the present invention.

In the present embodiment, two different waveforms, a first waveform 10 and a second waveform 20 shown in FIG. 5, are applied to the electrode 621. The first waveform 10 is used for ejecting ink at a high ejection speed. The second waveform 20 is used for decreasing the ejection speed of ink. The ink ejection device 600 is driven using the first waveform 10 at relatively low temperatures, for example, temperatures below 25° C., wherein the ink is highly viscous. The ink ejection device 600 is driven using the second driving waveform 20 at relatively high temperatures for example, at temperatures equal t or greater than 25° C. the ink has a low viscosity. By selectively using the first and second driving waveforms, variation in the ejection speed of ink can be minimized regardless of changes in the atmospheric temperature.

The first waveform 10 includes the first pulse signal A having a crest value or a level of V volts, or 20 volts in this example. The first pulse signal A has a width, of duration Wa equal to time duration T, or 8 msec in this example. The second waveform 20 includes the second pulse signal B also having a crest value or a level of V volts. The second pulse signal B has a duration Wb that is three times as long as the time duration T as shown in FIG. 5. Therefore, in this example the duration Wb of the second pulse signal B is 24 msec.

Figure 4:
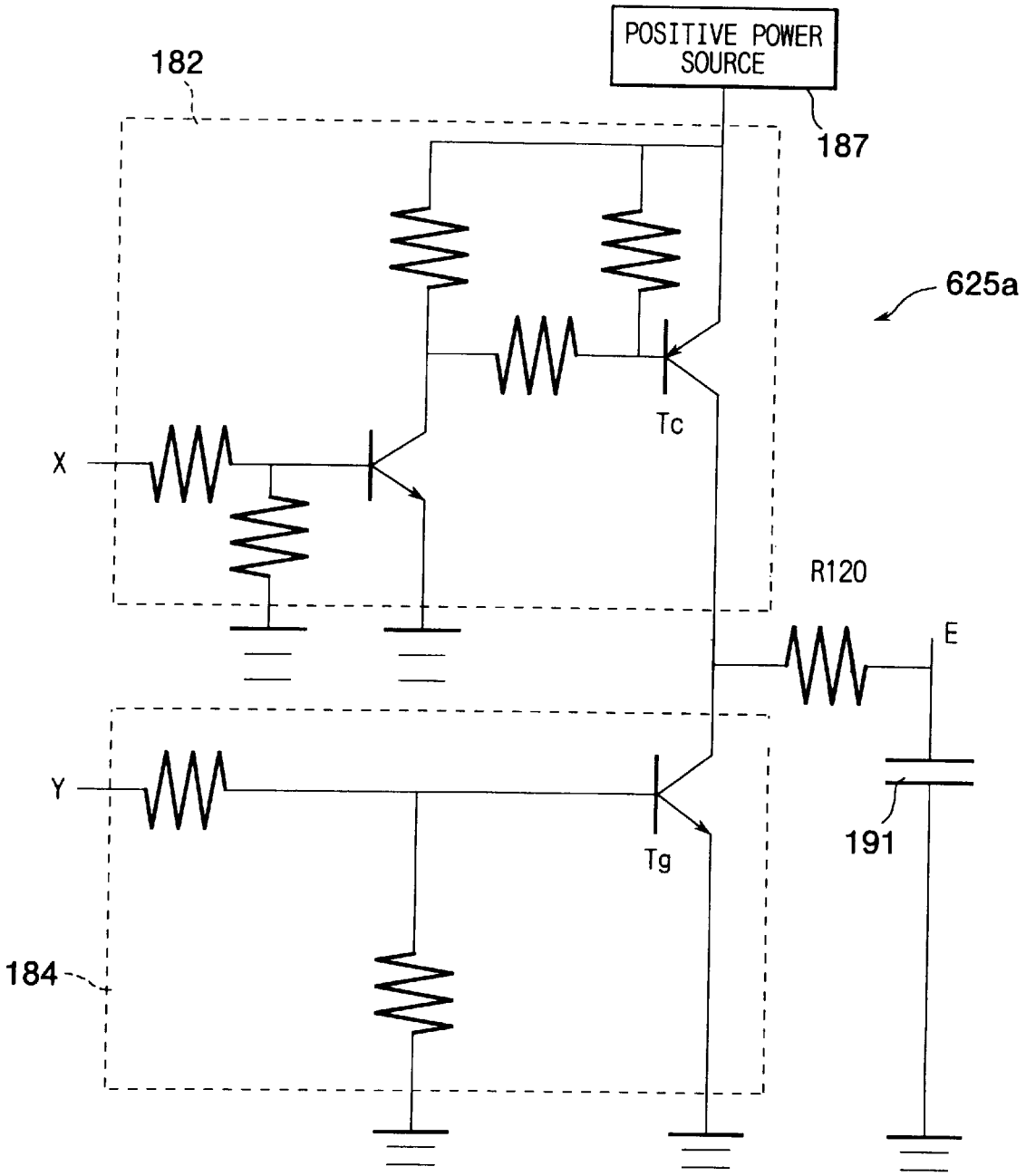
FIG. 4 is a circuit diagram showing a driving circuit for generating the voltage waveforms shown in FIGS. 5 and 8.

The actuator driving circuit 625*a* shown in FIG. 4 is driven by a single positive power source 187 and can selectively produces the voltages V and 0 (zero) to be applied to the electrodes 619 of the ink channel 613 in response to input signals X and Y. When the input signal X is ON and the input signal Y is OFF, then the voltage V is applied to a capacitor 191 whereas when the input signal Y is rendered ON and the input signal X is rendered OFF, zero voltage is applied to the capacitor 191. The actuator wall 603 and the electrodes 619 and 621 at both sides thereof form the capacitor 191.

The actuator driving circuit 625*a* includes a charge circuit 182 for charging the capacitor 191 and a discharge circuit 184 for discharging charges in the capacitor 191. When the input signal X is ON, a transistor Tc in the charge circuit 182 is rendered conductive, so that the voltage V of 20 V from the positive power source 187 is applied to the electrode E of the capacitor 191 through a resistor R120. When the input signal Y is ON, a transistor Tg in the discharge circuit 184 is rendered conductive, so that the electrode E of the capacitor 191 is connected to ground through the resistor R120.

Figure 6:
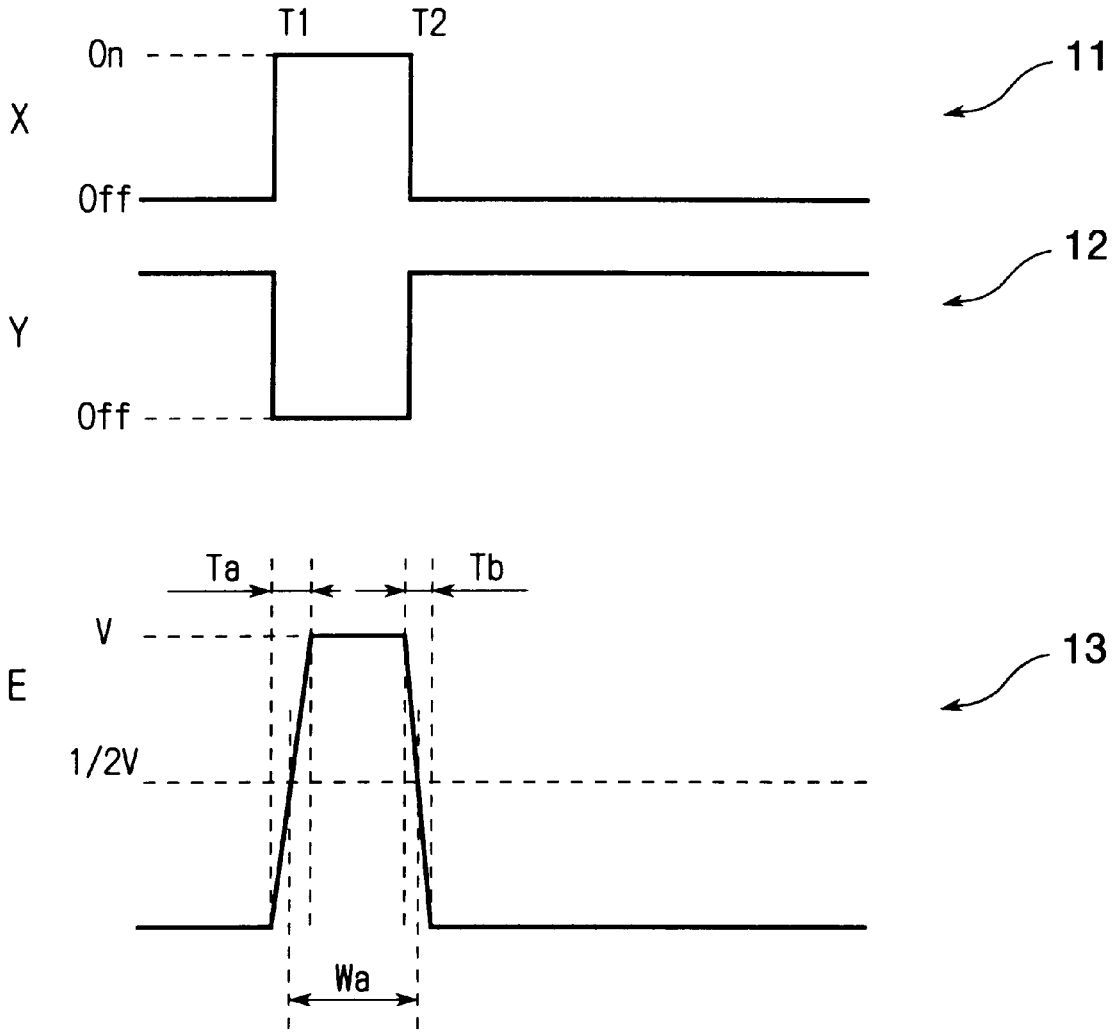
FIG. 6 is a timing chart illustrating a waveform used in driving the ink ejection device according to the first embodiment of the present invention.

As shown in FIG. 6, input signals X and Y supplied from the microcomputer have phases with an inverse relation. A timing chart 11 of the input signal X shows that the input signal X is normally at a low level (OFF) and rendered high (ON) at timing T1 and low at timing T2. A high level input signal X renders the transistor Tc conductive so that a positive voltage V of 20V from the positive power source 187 is applied to the electrode E of the capacitor 191 via the a resistor R120. A high level input signal Y renders the transistor Tg conductive so that the electrode E of the capacitor 191 is grounded via the resistor R120. The capacitor 191 is formed by the electrodes 619 and 621 with the actuator wall 603 sandwiched therebetween.

The output waveform 13 at the electrode E at this time is first at 0 volt, which is in normal condition. Then at the timing T1, charging of the capacitor 191 starts and continues for a charging duration Ta determined by the transistor Tc, the resistor R120, and the capacitor 191 until the voltage V is achieved. At timing T2, discharge of the capacitor 191 is started and continued until the voltage applied to the electrode E returns to 0 volt after a discharging duration Tb determined by the transistor Tg, the resistor R120, and the capacitor 191.

As described above, the circuit shown in FIG. 4, requires a time interval Ta to develop the voltage from 0 volt to V volts and a time interval Tb to discharge the voltage from V volts to 0 volt. Because of this delay in the rising and falling edges of the waveform 13, the timings T1, T2 are set so that the duration Wa of the first pulse signal A and the duration Wb of the second pulse signal B are determined based on half the voltage V, i.e., ½ V or 10V.

Figure 7:
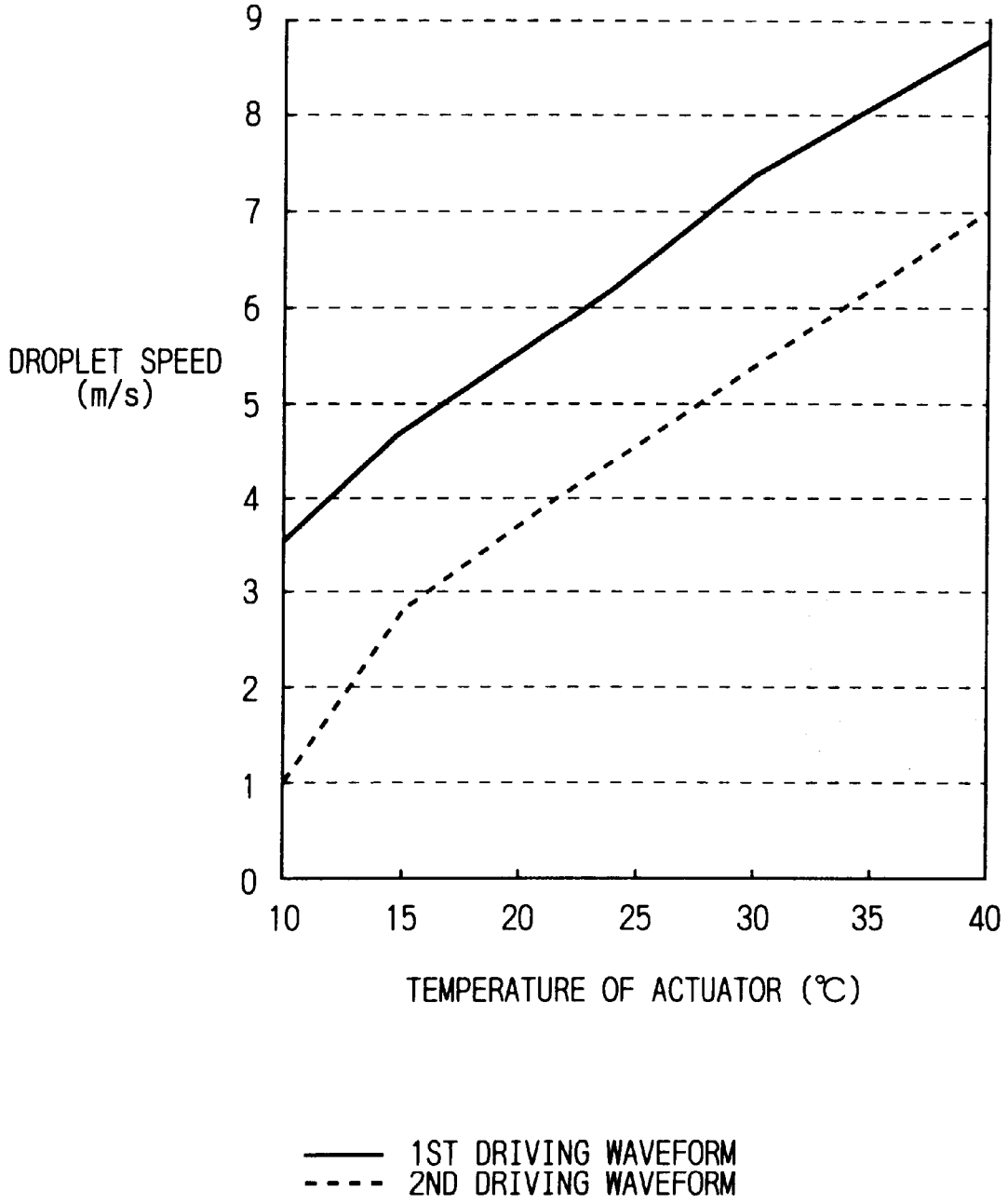
FIG. 7 is a graph illustrating results of experiments showing the relationship between ink ejection speed and temperature of an actuator when performed with the first and second waveforms according to the first embodiment of the present invention.

Ink ejection tests were performed using the drive method described above. During the tests ejection speed was measured for droplets eject using the first and second waveforms 10, 20 at a drive voltage of 20V and varying temperatures from 10° C. to 40° C. As shown in FIG. 7, the ink ejection speed produced by the first waveform 10 is about 2 m/sec faster than produced by the second waveform 20. Accordingly, by driving the actuator walls using the first driving waveform 10 and using the second driving waveform 20 when the temperature is 25° C. or greater, ink can be ejected at a stable ink ejection speed regardless of the temperature. In this way, good quality printing can be achieved.

In the method of driving the ink ejection device according to the first embodiment of the present invention, a single positive power source 187 suffices to produce the first pulse signal A of the first waveform 10 and the second pulse signal B of the second waveform 20, because those signals have the same positive voltage V. Therefore, the circuit configuration used in this embodiment is simpler and less costly than the conventional circuit configuration which outputs various voltage levels using more than two power sources.

In the first embodiment, although the positive power source is used, a negative power source can be used if the polarization direction of the piezoelectric element is inverted.

Also, the predetermined temperature of the ink jet head can be set to 20° C. or other value instead of 25° C. Further, spaces 615 provided between the ink channels 613 can be dispensed with. In addition, although in the above embodiment the volume of the ink channel 613 is changed by deforming both the lower part and the upper part of the actuator wall 603, either the upper part or the lower part may be formed from a material other than a piezoelectric material.

As described above, when atmospheric temperature is lower than the predetermined temperature, a first pulse signal having width T is applied to the actuator. When the atmospheric temperature is equal to or above the predetermined temperature, a second pulse signal having the same voltage level as in the first pulse signal and the width 3T is applied to the actuator. In this way, impinging position of droplets can be more accurate and thus good quality of print image can be obtained.

According to the driving method of the first embodiment, the actuator forms at least a part of the ink chamber wall, and also at least a part of the ink chamber wall is formed from a piezoelectric member. Therefore, the ink chamber wall deforms to pressurize the ink in the ink chamber to eject ink so that good quality printing can be performed at a high speed.

Figure 8:
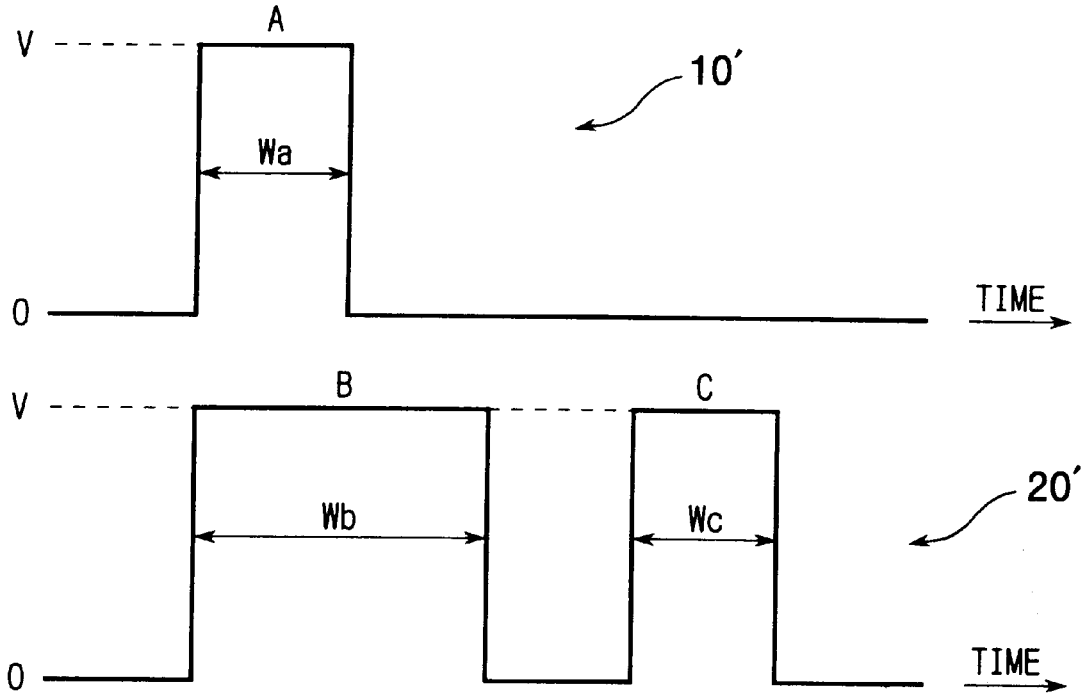
FIG. 8 is a diagram illustrating voltage waveform for driving the ink ejection device according to the second embodiment of the present invention.

Next, a second embodiment of the present invention will be described. The ink ejection device and the driving circuit as used in the first embodiment are also used in the second embodiment. FIG. 8 shows two driving waveforms, a first driving waveform 10' and a second driving waveform 20' applied to the electrodes 619 of the ink channel 613. The second driving waveform 10' is to reduce exothermic heat in the head to eject low viscosity ink at a reduced ejection speed. The first waveform 20 is used to increase exothermic heat in the head and eject high viscosity ink at an increased ejection speed. The ink ejection device 600 is driven using the first driving wave form 20 in a low temperature circumstance, for example, at a temperature below 25° C. when the ink is highly viscosus, and the ink ejection device 600 is driven using the second driving waveform 10 in a high temperature circumstance, for example, at a temperature above 25° C., when the ink is less viscosus. This enables reducing variations in ink ejection speed caused by variations in ambient temperature. By selectively using the first and second driving waveforms, the temperature of the ink jet head and the ink can be rapidly heated up from a low temperature to a high temperature region and stably maintained at the high temperature region.

The second waveform 10' includes the first ink-ejection pulse signal A having a crest value or a level of V volts, or 20 volts in this example. The first pulse signal A has a width, or duration Wa equal to a time duration T, or 8 msec long in this example.

The first waveform 20' includes a second non-ink-ejection pulse signal B' and a third ink-ejection pulse signal C also having a crest value or a level of V volts. The second pulse signal B' has a duration Wb that is two times as long as the time duration T (Wa). Also, the third pulse signal C has a width of duration Wc equal to time duration T. Therefore, in this example the duration Wb of the second pulse signal B is 16 msec long, and Wc of the third pulse signal C is 8 msec long.

Figure 9:
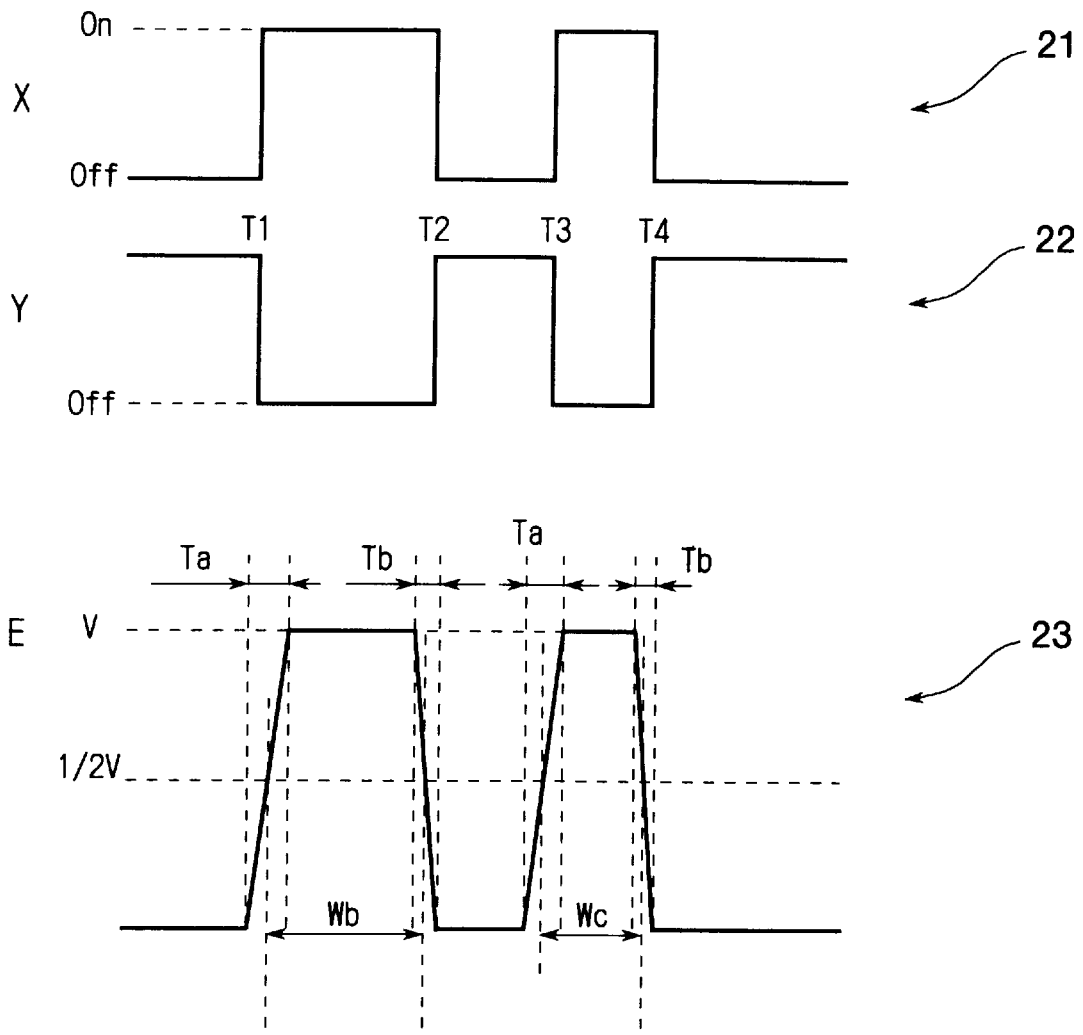
FIG. 9 is a timing chart illustrating a waveform used in driving the ink ejection device according to the second embodiment of the present invention.

FIG. 9 shows a timing chart 21 of output signals X, Y for applying and stopping application of voltage to electrodes 619 in the ink channel 613. The input signal X is normally at a low level (OFF). The input signal X is rendered high (ON) at timings T1, T3 and low (OFF) at timing T2, T4. The circuitry for the device of the second embodiment is the same as shown in FIG. 4 for the first embodiment. A high level input signal X renders the transistor Tc conductive so that a positive voltage V of 20V from the positive power source 187 is applied to the electrode E of the capacitor 191 via the resistor R120. A high level of the input signal Y renders the transistor Tg conductive so that the electrode E of the capacitor 191 is grounded via the resistor R120. The capacitor 191 is formed by the electrodes 619 and 621 with the actuator wall 603 sandwiched therebetween.

The output waveform 23 at the electrode E at this time is first at 0 volt, which is in a normal condition. Then at the timing T1, charging of the capacitor 191 starts and continues for a charging duration Ta determined by the transistor Tc, the resistor R120, and the capacitor 191 until the voltage V is achieved. During the charging duration Ta, the voltage is applied from the positive power source 187 through the transistor Tc, the resistor R120, and the capacitor 191.

At timing T2, discharge of the capacitor 191 is started and continued until the voltage applied to the electrode E returns to 0 volt after a discharging duration Tb determined by the transistor Tg, the resistor R120, and the capacitor 191. During the charging duration Tb, the voltage is applied from the positive power source 187 through the transistor Tc, the resistor R120, and the capacitor 191.

Subsequently, at the timing T3, charging of the capacitor 191 starts and continues for a charging duration Tc determined by the transistor Tc, the resistor R120, and the capacitor 191 until the voltage V is achieved. During the charging duration Ta, the voltage is applied from the positive power source 187 through the transistor Tc, the resistor R120, and the capacitor 191.

At timing T4, discharge of the capacitor 191 is started and continued until the voltage applied to the electrode E returns to 0 volt after a discharging duration Tb determined by the transistor Tg, the resistor R120, and the capacitor 191. During the charging duration Tb, the voltage is applied from the positive power source 187 through the transistor Tc, the resistor R120, and the capacitor 191.

As described above, the circuit shown in FIG. 4 requires a time interval Ta to develop the voltage from 0 volt to V volts and a time interval Tb to discharge the voltage from V volts to 0 volts. Because of this delay in the rising and falling edges of the waveform 23, the timings T1, T2, T3, and T4 are set so that the duration Wb of the second pulse signal B and the duration Wc of the third pulse signal C are determined based on half the voltage V, i.e., ½ V or 10V. Likewise, the duration Wa of the first pulse signal A is determined.

The ink jet head 600 uses piezoelectric ceramics. When the piezoelectric ceramics are deformed, that is, when the voltage is developed and discharged, the current flowing through the driving circuit heats up the silicon chip 625. The current flows through the driving circuit twice according to the second waveform 10 and four times according to the first waveform 20. Therefore, the silicon chip 625 is heated up faster by the first waveform 20 then with the second waveform 10.

Figure 10:
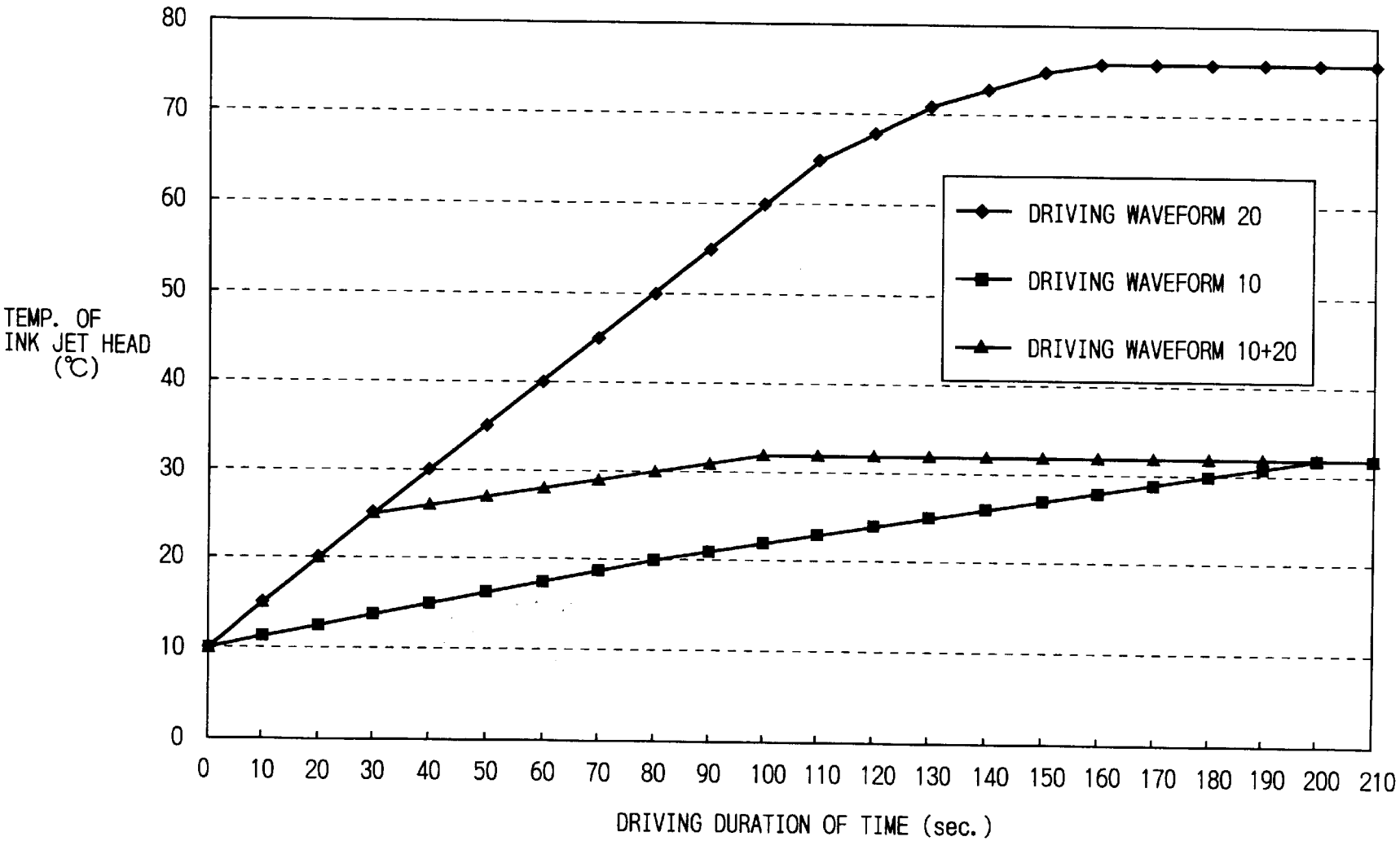
FIG. 10 is a graph illustrating results of experiments showing the temperature variation of an ink jet head and as driving the actuator using different pulse signals according to the second embodiment of the present invention.

Ink ejection tests were performed using the drive method of the second embodiment. During the tests, change in temperature of the ink jet head 600 from an initial temperature of 10° C. was measured when consecutively driving the actuator walls using a drive voltage of 20V applied according to either of the first and second waveforms 10', 20'. Also, change in temperature was measured when the actuator walls were driven using the second waveform 10', when temperature of the head 600 was less than 25° C. and using the first waveform 20' when the temperature is 25° C. or greater. As shown in FIG. 10, when the actuator walls are driven using the second waveform 10' only, the temperature of the ink jet head 600 increased at the rate of 7.5° C./min until leveling off at 32° C. after 200 sec. On the other hand, when the actuator walls were driven using the first waveform 20', the temperature increased at a rate of 30° C./min and stables until leveling off at 76° C. after 60 sec. In another word, when the actuator walls are driven using the second waveform 10', the temperature stabilizes at a relatively low temperature, but only after a long period of time. On the other hand, when the actuator walls are driven using the first waveform 20', the temperature stabilizes fairly quickly but at a high temperature.

However, by driving by using the second driving waveform 20' when the temperature is less than 25° C. and by using the first driving waveform 10' when the temperature is 25° C. or greater, the temperature of the ink jet head 600 reached 25° C. in 30 sec. and leveled off at 32° C. in 100 sec. That is, the temperature stabilized at a relatively low temperature in short period of time. Good quality printing can be achieved by minimizing variation in speed of ejected ink droplets caused by changes in viscosity ink accompanying variation in temperature of the ink jet head 600.

In the method of driving the ink ejection device according to the second embodiment of the present invention, because the first pulse signal A of the second waveform 10' and the second and third pulse signals B, C of the first waveform 20', all these signals can be produced by a single power source 187. Therefore, the circuit configuration used in this embodiment is simpler and less costly than conventional circuit configurations using a circuit which outputs various voltage levels using two or more power sources supplying different voltages.

Because the first waveform 20' includes two pulse signals and the second waveform includes one pulse signal, driving frequency can be increased.

Because in the first waveform 20', the third pule signal C for ejecting ink is applied after the second pulse B for not ejecting ink in the first waveform 20', the duration of time between the two pulse signals B and C can be adjusted so that the ink droplets can be ejected with proper volume and speed.

Ink ejection tests were further performed to measure the variation of ink ejection speed achieved by changing the duration W of the pulse signals in the firs and second waveforms 20', 10'. The actuator walls were driven at a temperature of 25° C. using a drive voltage of 20V applied at a frequency of 1 kHz. As shown In FIG. 11, ink ejection can be performed stably when the widths Wa, Wc of the first and third pulse signals A, C are set as an odd integer times the time duration T, that is, 1.0T, 3.0T, 5.0T, 7.0T. On the other hand, ink ejection cannot be performed when the with Wb of the second pulse signal B is 0.3T or smaller, in a ranges from 1.7T to 2.3T, from 3.7T to 4.3T, from 5.7T to 6.3T.

In the second embodiment of the present invention, the first waveform 20' includes two pulse signals; however, it can includes more, such as three or four pulse signals. In this case, the silicon chip 625 would heat up even faster. Therefore, the actuator can heat up to the stable temperature in a shorter period of time.

Also, the present invention according to the second embodiment can be applied to a printing device, such as a line head type printing device, without a carridge for supporting the ink jet head 600 and the silicon chip 625. In this case, a silicon chip and an ink jet head can be arranged close enough so that heat of the silicon chip can be transmitted to the ink jet head.

According to the second embodiment, when the temperature is lower than the predetermined temperature, the first waveform including a non-ink-ejection pulse signal and an ink-ejection pulse signal having the same crest value is applied to the actuator from the single power source to eject a single ink droplet. Because the number of times current flows through the drive circuit increases, the temperature of the actuator can be quickly raised to a desired temperature.

On the other hand, when the ambient temperature is equal to or greater than predetermined temperature, the second waveform including less pulse signals than the first waveform is applied to the actuator from the single power source to eject an ink droplet. The pulse signal of the second waveform has the same voltage level as in the pulse signals of the first waveform. In this way, the number of times current flows through the drive circuit can be reduced so that the temperature of the actuator stabilizes at a low temperature. Because the temperature of the ink jet head can stabilize at low temperature in a short period of time, good quality printing can be achieved by minimizing variation in speed of ejected ink droplets caused by changes in viscosity ink accompanying variation in temperature of the ink jet head 600.

According to the second embodiment, by application of pulse signal the actuator operates to increase the volume of the ink chamber, then return it to its initial volume. An ink droplet can be ejected by application of ink-ejection pulse signal having the width of odd integer times T. Also, current flows through the drive circuit without ejecting any ink droplets resulting from application of a non-ink-ejection pulse signal having a width of less than 0.3T and in a range from (N−0.3)T to (N+0.3)T, wherein N is even integer.

According to the second embodiment, the first waveform includes two pulse signals, one for not ejecting ink and another for ejecting ink, and the second waveform includes one pulse signal for ejecting ink. This can increase the driving frequency.

According to the second embodiment, the ink-ejection pulse signal is applied after the non-ink-ejection pulse signal in the first waveform. The duration of time between two pulse signals can be adjusted so that the ink droplet can be ejected with proper volume and speed.

What is claimed is:

1. A method of driving an ink ejection device that includes:

walls defining an ink channel, the ink channel having a volume filled with ink and a length defined by two ends opposite to each other;

a nozzle plate attached to one end of the ink channel and formed with a nozzle;

an actuator for changing the volume of the ink channel; and a driving circuit for driving said actuator by applying thereto pulses of voltage, the method comprising the steps of:

(a) when atmospheric temperature is under a predetermined value, said driving circuit applying a first pulse of voltage to said actuator, wherein said first pulse of voltage has a start edge, a termination edge, a first crest value, and a first duration of time between the start edge and the termination edge, the first duration of time being equal to a pressure wave propagating time required for a pressure wave imparted to the ink filled in said ink channel to propagate over the length of the ink channel; and (b) when the atmospheric temperature is above the predetermined value, said driving circuit applying a second pulse of voltage to said actuator, wherein said second pulse of voltage has a start edge, a termination edge, a second crest value equal to the first crest value, and a second duration of time between the start edge and the termination edge of said second pulse of voltage, the second duration of time being three times as long as the pressure wave propagating time.

2. The method according to claim 1, wherein said actuator is in the form of a wall defining the ink channel, at least a portion of said actuator being formed from a piezoelectric material.

3. The method according to claim 2, wherein the piezoelectric material is operable in a shear mode.

4. The method according to claim 3, wherein in response to each of the start edge of the first pulse of voltage and the start edge of the second pulse of voltage, the volume of the ink channel is increased from an initial volume to an increased volume, causing to generate the pressure wave in the ink filling the ink channel, and in response to each of the termination edge of the first pulse of voltage and the termination edge of the second pulse of voltage, the volume of the ink chamber reverts to the initial volume, thereby ejecting an ink droplet from the nozzle.

5. The method according to claim 1, wherein the ink has a temperature-dependent viscosity wherein the viscosity of the ink increases when the atmospheric temperature is lowered.

6. The method according to claim 1, wherein said driving circuit includes a voltage source supplying a voltage having a predetermined voltage level, and wherein the first pulse of voltage and the second pulse of voltage are produced from the voltage supplied by said voltage source so that the first crest value and the second crest value are substantially equal to the predetermined voltage level.

7. A method of driving an ink ejection device that includes:

walls defining an ink channel, the ink channel having a volume filled with ink and a length defined by two ends opposite to each other, the ink having a viscosity;

a nozzle plate attached to one end of the ink channel and formed with a nozzle;

an actuator for changing the volume of the ink channel;

a voltage source for supplying a voltage having a predetermined voltage level; and a driving circuit, disposed in the vicinity of said actuator, for driving said actuator;

the method comprising the steps of:

(a) monitoring temperature of ink and determining whether the temperature of ink is above a predetermined value;

(b) when determination made in step (a) indicates that the temperature of ink is under a predetermined value, heating the ink filling in the ink channel to lower the viscosity of the ink; and (c) when determination made in step (a) indicates that the temperature of ink is above the predetermined value, said driving circuit applying an ejection pulse signal to said actuator, causing to eject an ink droplet from the nozzle.

8. The method according to claim 7, wherein after heating the ink in step (b), said driving circuit applies the ejection pulse signal to said actuator, causing to eject the ink droplet from the nozzle.

9. The method according to claim 8, wherein said driving circuit generates heat to be applied to said actuator.

10. The method according to claim 9, wherein said driving circuit produces at least one non-ejection pulse signal to generate the heat.

11. The method according to claim 10, wherein said at least one non-ejection pulse signal is applied to said actuator, wherein said non-ejection pulse signal does not cause to eject the ink droplet from the nozzle.

12. The method according to claim 11, wherein in response to the ejection pulse signal, the volume of the ink channel is increased from an initial volume to an increased volume, causing to generate a pressure wave in the ink filling the ink channel, and then the volume of the ink chamber reverts to the initial volume, thereby ejecting the ink droplet from the nozzle, wherein said ejection pulse signal has a duration of time substantially equal to a time duration given by multiplying an odd number to a pressure wave propagating time required for a pressure wave imparted to the ink filled in said ink channel to propagate over the length of the ink channel, and wherein said non-ejection pulse signal has a duration of time in a range from (N−0.3)T to (N+0.3)T where N is an odd number and T is the pressure wave propagating time.

13. A method of driving an ink ejection device that includes:

walls defining an ink channel, the ink channel having a volume filled with ink and a length defined by two ends opposite to each other, the ink having a viscosity;

a nozzle plate attached to one end of the ink channel and formed with a nozzle;

an actuator for changing the volume of the ink channel;

a voltage source for supplying a voltage having a predetermined voltage level; and a driving circuit for driving said actuator;

the method comprising the steps of:

(a) when atmospheric temperature is under a predetermined value, said driving circuit applying a first pulse train to said actuator, the first pulse train consisting of a first number of pulse signals including an ejection pulse signal and at least one non-ejection pulse signal, said ejection pulse signal and said at least one non-ejection pulse signal being produced from the voltage supplied by said voltage source so as to have a crest value substantially equal to the predetermined voltage level, wherein said ejection pulse signal, when applied to said actuator, causes to eject an ink droplet from the nozzle, said at least one non-ejection pulse signal, when applied to said actuator, does not cause to eject the ink droplet from the nozzle, and said driving circuit generates heat resulting from application of said at least one non-ejection signal to said actuator, the heat being applied to the ink filling in the ink channel to lower the viscosity of the ink; and (b) when the atmospheric temperature is above the predetermined value, said driving circuit applying a second pulse train to said actuator, the second pulse train consisting of a second number of pulse signals smaller than the first number of pulse signals, the second pulse train including the ejection pulse signal which, when applied to said actuator, causes to eject the ink droplet from the nozzle 14.

14. The method according to claim 13, wherein in response to the ejection pulse signal, the volume of the ink channel is increased from an initial volume to an increased volume, causing to generate a pressure wave in the ink filling the ink channel, and then the volume of the ink chamber reverts to the initial volume, thereby ejecting the ink droplet from the nozzle, wherein said ejection pulse signal has a duration of time substantially equal to a time duration given by multiplying an odd number to a pressure wave propagating time required for a pressure wave imparted to the ink filled in said ink channel to propagate over the length of the ink channel, and wherein said non-ejection pulse signal has a duration of time in a range from (N−0.3)T to (N+0.3)T where N is an odd number and T is the pressure wave propagating time.

15. The method according to claim 13, wherein said first pulse train consists of one ejection pulse signal and one non-ejection pulse signal, and said second pulse train consists of one ejection pulse signal.

16. The method according to claim 13, wherein in step (a), said ejection pulse signal is applied to said actuator after applying said non-ejection pulse signal to the actuator.

17. The method according to claim 13, wherein said actuator is in the form of a wall defining the ink channel, at least a portion of said actuator being formed from a piezoelectric material.

18. The method according to claim 17, wherein the piezoelectric material is operable in a shear mode.

* * * * *